US011364419B2

(12) United States Patent
Radow et al.

(10) Patent No.: US 11,364,419 B2
(45) Date of Patent: Jun. 21, 2022

(54) EXERCISE EQUIPMENT WITH MUSIC SYNCHRONIZATION

(71) Applicant: Scott B. Radow, Reno, NV (US)

(72) Inventors: Scott B. Radow, Reno, NV (US); Frank D. Sundermeyer, Prospect, CT (US)

(73) Assignee: Scott B. Radow, Reno, NV (US)

( * ) Notice: Subject to any disclaimer, the term of this patent is extended or adjusted under 35 U.S.C. 154(b) by 0 days.

(21) Appl. No.: 16/797,518

(22) Filed: Feb. 21, 2020

(65) Prior Publication Data

US 2020/0269092 A1 Aug. 27, 2020

Related U.S. Application Data

(60) Provisional application No. 62/808,534, filed on Feb. 21, 2019.

(51) Int. Cl.
*A63B 24/00* (2006.01)
*A63B 21/005* (2006.01)

(52) U.S. Cl.
CPC ..... *A63B 24/0087* (2013.01); *A63B 21/0056* (2013.01); *A63B 2024/0068* (2013.01); *A63B 2024/0093* (2013.01)

(58) Field of Classification Search
None
See application file for complete search history.

(56) References Cited

U.S. PATENT DOCUMENTS 3,375,717 A 4/1968 Impellizzeri et al.
3,589,193 A 6/1971 Thornton
3,859,840 A 1/1975 Gause
3,903,613 A 9/1975 Bisberg
3,964,742 A 6/1976 Carnielli
4,060,239 A 11/1977 Pfleiderer et al.
4,084,810 A 4/1978 Forsman
(Continued)

FOREIGN PATENT DOCUMENTS

DE 3218086 A1 12/1983
DE 20311319 U1 12/2003
(Continued)

OTHER PUBLICATIONS

James et al., "A Unified Treatment of Elastostatic Contact Simulation for Real Time Haptics," University of British Columbia, http://www.haptics-e.org, vol. 2, No. 1, Haptics-e, Sep. 27, 2001 (13 pages).

(Continued)

*Primary Examiner* — Sundhara M Ganesan
*Assistant Examiner* — Shila Jalalzadeh Abyaneh
(74) *Attorney, Agent, or Firm* — Price Heneveld LLP

(57) ABSTRACT

An exercise system includes a movable input member and a brake. The system further includes a controller that may be configured to control a resistance force of the brake acting on the movable input member to synchronize movement of the movable input member with a music beat. The controller may utilize a difference between a target speed and a measured speed, and a difference between a target phase and a measured phase to control the resistance force. One or both of the target speed and the target phase may be determined, based at least in part, on a music beat or other repetitive input.

25 Claims, 4 Drawing Sheets

(56) References Cited

U.S. PATENT DOCUMENTS 4,235,437 A 11/1980 Book et al.
4,261,562 A 4/1981 Flavell
4,358,105 A 11/1982 Sweeney, Jr.
4,452,447 A 6/1984 Lepley et al.
4,542,897 A 9/1985 Melton et al.
4,571,680 A 2/1986 Wu
4,600,016 A 7/1986 Boyd et al.
4,613,129 A 9/1986 Schroeder et al.
4,642,070 A 2/1987 Walker
4,647,039 A 3/1987 Noffsinger
4,678,182 A 7/1987 Nakao et al.
4,687,195 A 8/1987 Potts
4,687,196 A 8/1987 Dubrinsky et al.
4,709,917 A 12/1987 Yang
4,765,315 A 8/1988 Krukowski
4,775,145 A 10/1988 Tsuyama
4,817,938 A 4/1989 Nakao et al.
4,822,037 A 4/1989 Makansi et al.
4,824,104 A 4/1989 Bloch
4,869,497 A 9/1989 Stewart et al.
4,880,230 A 11/1989 Cook
4,890,495 A 1/1990 Slane
4,891,764 A 1/1990 McIntosh
4,934,692 A 6/1990 Owens
4,938,475 A 7/1990 Sargeant et al.
4,941,652 A 7/1990 Nagano et al.
4,958,831 A 9/1990 Kim
4,976,424 A 12/1990 Sargeant et al.
4,998,725 A 3/1991 Watterson et al.
5,011,142 A 4/1991 Eckler
5,018,726 A 5/1991 Yorioka
5,027,303 A 6/1991 Witte
5,067,710 A 11/1991 Watterson et al.
5,070,816 A 12/1991 Wehrell
5,137,501 A * 8/1992 Mertesdorf ..... A63B 22/001 482/57
5,154,677 A 10/1992 Ito
5,163,886 A 11/1992 Seol
5,181,904 A 1/1993 Cook et al.
5,215,468 A 6/1993 Lauffer et al.
5,230,673 A 7/1993 Maeyama et al.
5,234,392 A 8/1993 Clark
5,242,339 A 9/1993 Thornton
5,256,115 A 10/1993 Scholder et al.
5,256,117 A 10/1993 Potts et al.
5,259,611 A 11/1993 Dalebout et al.
5,267,925 A 12/1993 Boyd
5,312,311 A 5/1994 Pearson
5,314,390 A 5/1994 Westing et al.
5,318,487 A 6/1994 Golen et al.
5,324,242 A 6/1994 Lo
5,382,207 A 1/1995 Skowronski et al.
5,466,203 A 11/1995 Chen
5,470,293 A 11/1995 Schoenenberger
5,492,513 A 2/1996 Wang
5,545,112 A 8/1996 Densmore et al.
5,562,572 A 10/1996 Carmein
5,577,598 A 11/1996 Schoenenberger
5,580,249 A 12/1996 Jacobsen et al.
5,583,403 A 12/1996 Anjanappa et al.
5,587,937 A 12/1996 Massie et al.
5,625,576 A 4/1997 Massie et al.
5,690,591 A 11/1997 Kenmochi et al.
5,704,253 A 1/1998 Book et al.
5,736,612 A 4/1998 Van Dongen et al.
5,768,702 A 6/1998 Kim
5,779,596 A 7/1998 Weber
5,872,438 A 2/1999 Roston
5,888,172 A 3/1999 Andrus et al.
5,898,599 A 4/1999 Massie et al.
5,919,115 A 7/1999 Horowitz et al.
5,947,869 A 9/1999 Shea
5,952,796 A 9/1999 Colgate et al.
5,980,256 A 11/1999 Carmein
5,984,880 A 11/1999 Lander et al.
6,028,593 A 2/2000 Rosenberg et al.
6,050,822 A 4/2000 Faughn
6,050,920 A 4/2000 Ehrenfried
6,056,670 A 5/2000 Shu et al.
6,059,696 A 5/2000 Bohmer et al.
6,066,075 A 5/2000 Poulton
6,126,571 A 10/2000 Parks
6,126,575 A 10/2000 Wang
6,142,913 A 11/2000 Ewert
6,147,674 A 11/2000 Rosenberg et al.
6,152,854 A 11/2000 Carmein
6,162,151 A 12/2000 Tani et al.
6,162,189 A 12/2000 Girone et al.
6,171,218 B1 1/2001 Shea
6,231,527 B1 5/2001 Sol
6,234,939 B1 5/2001 Moser et al.
6,251,048 B1 6/2001 Kaufman
6,267,709 B1 7/2001 Jacques et al.
6,356,848 B1 3/2002 Cote et al.
6,366,272 B1 4/2002 Rosenberg et al.
6,405,158 B1 6/2002 Massie et al.
6,418,797 B1 7/2002 Ambrosina et al.
6,436,008 B1 8/2002 Skowronski et al.
6,450,922 B1 9/2002 Henderson et al.
6,454,679 B1 9/2002 Radow
6,464,618 B1 10/2002 Shea
6,475,115 B1 11/2002 Candito et al.
6,482,128 B1 11/2002 Michalow
6,527,674 B1 3/2003 Clem
6,527,681 B2 3/2003 Tacx
6,554,252 B2 4/2003 Kazerooni et al.
6,572,511 B1 6/2003 Volpe
6,593,710 B2 7/2003 Reck
6,605,020 B1 * 8/2003 Huang ..... A63B 22/0242 482/4
6,605,021 B2 8/2003 Kobayashi et al.
6,607,471 B2 8/2003 Reck
6,634,992 B1 10/2003 Ogawa
6,652,425 B1 11/2003 Martin et al.
6,659,917 B1 12/2003 Tacx
6,676,569 B1 1/2004 Radow
6,730,003 B1 5/2004 Phillips
6,736,762 B2 5/2004 Chen
6,749,537 B1 6/2004 Hickman
6,786,848 B2 9/2004 Yamashita et al.
6,827,579 B2 12/2004 Burdea et al.
6,852,068 B2 2/2005 Ogawa
6,853,965 B2 2/2005 Massie et al.
6,918,860 B1 7/2005 Nusbaum
6,921,351 B1 7/2005 Hickman et al.
6,930,590 B2 8/2005 Ling et al.
7,004,888 B1 2/2006 Weng
7,027,055 B2 4/2006 Anderson et al.
7,033,176 B2 4/2006 Feldman et al.
7,039,866 B1 5/2006 Rosenberg et al.
7,044,891 B1 5/2006 Rivera
7,047,817 B2 5/2006 Lanham
7,050,050 B2 5/2006 Tackett
7,066,865 B2 6/2006 Radow
7,090,620 B1 8/2006 Barlow
7,094,184 B1 8/2006 Chen et al.
7,097,596 B2 8/2006 Yang
7,113,166 B1 9/2006 Rosenberg et al.
7,158,112 B2 1/2007 Rosenberg et al.
7,163,490 B2 1/2007 Chen
7,205,981 B2 4/2007 Cunningham
7,220,219 B2 5/2007 Papadopoulos et al.
7,257,468 B1 8/2007 Costa et al.
7,280,871 B2 10/2007 Davis et al.
7,354,380 B2 4/2008 Volpe, Jr.
7,608,015 B2 10/2009 Radow
7,641,597 B2 1/2010 Schmidt
7,833,135 B2 * 11/2010 Radow ..... A63B 71/0622 482/57
7,841,964 B2 11/2010 Radow
9,713,744 B2 7/2017 Suzuki
2001/0011052 A1 8/2001 Shu et al.
2001/0019985 A1 9/2001 Reck
2001/0036883 A1 11/2001 Suzuki

(56) References Cited

U.S. PATENT DOCUMENTS

| | | | | |
|---|---|---|---|---|
| 2002/0013197 | A1 | 1/2002 | Tacx | |
| 2002/0016236 | A1 | 2/2002 | Stearns et al. | |
| 2002/0077221 | A1 | 6/2002 | Dalebout et al. | |
| 2002/0147079 | A1 | 10/2002 | Kalnbach | |
| 2003/0013995 | A1 | 1/2003 | Oshima et al. | |
| 2003/0073546 | A1 | 4/2003 | Lassanske et al. | |
| 2004/0034282 | A1 | 2/2004 | Quaid, III | |
| 2004/0034283 | A1 | 2/2004 | Quaid, III | |
| 2004/0034302 | A1 | 2/2004 | Abovitz et al. | |
| 2004/0034795 | A1 | 2/2004 | Anderson et al. | |
| 2004/0036721 | A1 | 2/2004 | Anderson et al. | |
| 2004/0040805 | A1 | 3/2004 | Bailey | |
| 2004/0106502 | A1 | 6/2004 | Sher | |
| 2004/0106916 | A1 | 6/2004 | Quaid et al. | |
| 2004/0127335 | A1* | 7/2004 | Watterson ..... | A63B 22/0023 482/8 |
| 2004/0248709 | A1 | 12/2004 | Rodgers, Jr. | |
| 2005/0014610 | A1 | 1/2005 | Wu | |
| 2005/0024331 | A1 | 2/2005 | Berkley et al. | |
| 2005/0107221 | A1 | 5/2005 | Vohryzka | |
| 2005/0142424 | A1 | 6/2005 | Homma et al. | |
| 2005/0148432 | A1 | 7/2005 | Carmein | |
| 2005/0219228 | A1 | 10/2005 | Alameh et al. | |
| 2005/0222830 | A1 | 10/2005 | Massie et al. | |
| 2005/0227823 | A1 | 10/2005 | Liao | |
| 2005/0233285 | A1 | 10/2005 | Miyamaru et al. | |
| 2005/0264527 | A1 | 12/2005 | Lin | |
| 2006/0003872 | A1 | 1/2006 | Chiles et al. | |
| 2006/0030383 | A1 | 2/2006 | Rosenberg et al. | |
| 2006/0064223 | A1 | 3/2006 | Voss | |
| 2006/0094569 | A1 | 5/2006 | Day | |
| 2006/0106326 | A1 | 5/2006 | Krebs et al. | |
| 2006/0166790 | A1 | 7/2006 | Wang | |
| 2006/0179837 | A1 | 8/2006 | Buerger et al. | |
| 2006/0180225 | A1 | 8/2006 | Buerger et al. | |
| 2006/0190093 | A1 | 8/2006 | Buerger et al. | |
| 2006/0234840 | A1 | 10/2006 | Watson et al. | |
| 2006/0281606 | A1 | 12/2006 | Radow | |
| 2006/0293617 | A1 | 12/2006 | Einav et al. | |
| 2007/0010772 | A1 | 1/2007 | Ryan | |
| 2007/0013655 | A1 | 1/2007 | Rosenberg et al. | |
| 2007/0023244 | A1 | 2/2007 | Carlson et al. | |
| 2007/0044641 | A1* | 3/2007 | McKinney ..... | G09B 19/0038 84/612 |
| 2007/0049461 | A1 | 3/2007 | Kim et al. | |
| 2007/0082788 | A1 | 4/2007 | Ciervo | |
| 2007/0232465 | A1 | 10/2007 | Puzey | |
| 2007/0249468 | A1 | 10/2007 | Chen | |
| 2007/0259756 | A1 | 11/2007 | Kuykendall | |
| 2007/0275831 | A1 | 11/2007 | Yoshida et al. | |
| 2008/0097633 | A1 | 4/2008 | Jochelson et al. | |
| 2008/0103022 | A1* | 5/2008 | Dvorak ..... | A63B 71/0622 482/3 |
| 2008/0125291 | A1 | 5/2008 | Watt et al. | |
| 2008/0139307 | A1 | 6/2008 | Ueshima et al. | |
| 2009/0062080 | A1 | 3/2009 | Guy et al. | |
| 2009/0131224 | A1 | 5/2009 | Yuen | |
| 2009/0253558 | A1 | 10/2009 | Lofgren et al. | |
| 2009/0298651 | A1 | 12/2009 | Stewart | |
| 2010/0075806 | A1 | 3/2010 | Montgomery | |
| 2013/0008301 | A1 | 1/2013 | Naik et al. | |
| 2013/0116091 | A1* | 5/2013 | Fritz ..... | A63B 71/0622 482/4 |
| 2014/0038781 | A1 | 2/2014 | Foley et al. | |
| 2014/0208923 | A1 | 7/2014 | Bowen | |

FOREIGN PATENT DOCUMENTS

| | | | | |
|---|---|---|---|---|
| KR | 20100096530 | | * | 9/2010 |
| KR | 20100096530 | A | * | 9/2010 |
| NL | 1008474 | C | | 9/1999 |
| NL | 1019154 | C2 | | 4/2003 |
| WO | 9636399 | A1 | | 11/1996 |
| WO | 0124892 | A2 | | 4/2001 |

OTHER PUBLICATIONS

Weisenberger et al., "Judging the Orientation of Sinusoidal and Square-Wave Virtual Gratings Presented via 2-DOF and 3-DOF Haptic Interfaces," Haptics-e vol. 1, No. 4, Mar. 28, 2000 (20 pages).

Mahvash et al., "Haptic Rendering of Cutting: A Fracture Mechanics Approach," Department of Electrical and Computer Engineering & Center for Intelligent Machines, McGill University, Canada, Haptics-e, vol. 2, No. 3, Nov. 21, 2001 (12 pages).

Gillespie, "Kane's Equations for Haptic Display of Multibody Systems," University of Michigan, Department of Mechanical Engineering, Haptics-e, vol. 3, No. 2, Aug. 18, 2003 (20 pages).

Wagner et al., "Design and Performance of a Tactile Shape Display Using RC Servomotors," vol. 3, No. 4, Aug. 6, 2004 (6 pages).

Gosline et al., "Haptic Simulation of Linear Elastic Media with Fluid Inclusions," Department of Electrical and Computer Engineering, University of British Columbia, Vancouver, Canada, vol. 3, No. 5, Mar. 30, 2005 (11 pages).

Dreifaldt et al., "The construction of a Haptic application in a Virtual Environment as a post-Stroke arm Rehabilitation exercise," Mar. 23, 2006 (76 pages).

Harwin, "Arm wrestling with the robots," Department of Cybernetics, University of Reading, in association with the Oxford Trust for Venturefest 2004, (7 pages).

Willet, "Comprehensive Power Meter Review—One Geek Perspective, Take Two," http://www.biketechreview.com/archive/pm_review.htm, Mar. 5, 2003 (9 pages).

Hayward et al., "Performance Measures for Haptic Interfaces," McGill University, Center for Intelligent Machines, In Robotics Research: The 7th Int. Symposium, Giralt, G., Hirzinger, G., Eds., pp. 195-207, Springer Verlag. 1996. (12 pages).

Carignan et al., "Closed-Loop Force Control for Haptic Simulation of Virtual Environments," Haptics-e, vol. 1, No. 2, Feb. 23, 2000 (14 pages).

Lloyd et al., "The Mechanical Efficiency of Treadmill Running Against a Horizontal Impeding Force," University of Laboratory of Physiology, Oxford, J. Physicl. (1972), 223, pp. 355, 363, Dec. 6, 1971 (10 pages).

Vaughan, "Simulation of a sprinter. Part I. Development of a model," Int. J Biomed Comput Jan. 1983; 14(1): 65-74 (12 pages).

Vaughan, "Simulation of a sprinter. Part II. Implementation on a programmable calculator," Int J Biomed Comput Jan. 1983; 14(1): 75-83 (1 page).

Enoka, "Neural Adaptations With Chronic Physical Activity," Department of Kinesiology, University of Colorado, Boulder, Colorado, J. Biomechanics vol. 30, No. 5, 1997, 30 (5), pp. 447-454 (9 pages).

Guelch, "Force-Velocity Relations in Human Skeletal Muscle," Int J. Sports Med. 1994 (10 pages).

Hakkinen, "Neuromuscular Adaptation during Strength Training, Aging, Detraining, and Immobilization," Department of Biology of Physical Activity, University of Jyvaskyla, Finland, Critical Reviews in Physical and Rehabilitation Medicine, 1994 (39 pages).

Li, et al., "Control of Smart Exercise Machines—Part I: Problem Formulation and Nonadaptive Control," IEEE/ASME Transactions on Mechatronics, vol. 2, No. 4, Dec. 1997, pp. 237-247 (11 pages).

* cited by examiner

EXERCISE EQUIPMENT WITH MUSIC SYNCHRONIZATION

CROSS-REFERENCE TO RELATED APPLICATION

This application claims the benefit under 35 U.S.C. § 119(e) to U.S. Provisional Patent Application No. 62/808,534, filed Feb. 21, 2019, entitled "EXERCISE EQUIPMENT WITH MUSIC SYNCHRONIZATION," which is incorporated herein by reference in its entirety.

BACKGROUND OF THE INVENTION

Various types of stationary exercise devices have been developed. Examples include stationary bikes, bike trainers, rowing machines, stair climbers, elliptical machines, cross trainers, alternative motion machines, etc. Known devices may control the resistance force experienced by a user based on one or more inputs such as velocity and user-selected difficulty or resistance.

SUMMARY OF THE INVENTION

One aspect of the present disclosure is an exercise system including a movable input member that moves while a force is applied to the movable input member by a user. The exercise system includes a brake that is configured to generate a resistance force that tends to resist movement of the movable input member when a user applies a force to the movable input member. The system further includes a controller that is operably connected to the brake. The controller may be configured to control the resistance force to synchronize movement of the movable input member with a music beat. The controller may be configured to implement speed control (e.g. constant (isokinetic) speed, approximately constant speed, or other suitable speed control) and/or phase control. The controller may be configured to implement the speed control and the phase control according to predefined criteria.

The predefined criteria may, optionally, comprise upper and lower bounds of a range of target velocities.

The controller may, optionally, be configured to determine a speed (or velocity) error comprising a difference between a target speed (or velocity) and a measured speed (or velocity), and to utilize the speed (or velocity) error as an input for speed control (e.g. constant isokinetic speed control).

The controller may, optionally, be configured to determine a phase error comprising a difference between a target phase and a measured phase, and to utilize the phase error as an input for phase control.

The controller may be configured to optionally increase the resistance force when a measured speed (or velocity) is greater than a target speed (or velocity), when the phase control is being utilized (implemented) by the controller.

The controller may, optionally, be configured to reduce the resistance force when a measured speed (or velocity) is less than target speed (or velocity) to implement the speed control.

The controller may, optionally, be configured to control the resistance force utilizing a difference between a target phase and a measured phase to implement the phase control.

The controller may, optionally, be configured to vary the resistance force linearly (or nonlinearly) as a function of the difference between the target phase and the measured phase to implement the phase control.

The movable input member may, optionally, comprise a crank of a stationary exercise bike, and the exercise device may include one or more sensors that are configured to measure position and speed (or velocity) of the crank.

The controller may, optionally, be configured to determine a speed (or velocity) error by taking a difference between a measured speed (or velocity) and a target speed (or velocity).

The controller may, optionally, be configured to determine a phase error by taking a difference between a measured phase and a target phase.

The target speed (or velocity) and/or the target phase may, optionally, be determined utilizing a music beat.

The target speed (or velocity) may, optionally, comprise a target RPM for which there are one, two, or more music beats during each revolution of the crank of a stationary exercise device such as a bike.

The target phase may, optionally, comprise target positions of a movable member such as a pedal or handle and corresponding target times.

The phase error may, optionally, comprise a difference in position between the target position of a pedal or other movable member and the measured position at the target time corresponding to the target position.

The controller may, optionally, be configured to rapidly determine the speed (or velocity) error and the phase error during operation of the exercise device. If the exercise device comprises a stationary bike, the controller may be configured to adjust the resistance force a plurality of times during each revolution of the crank of the stationary bike based on at least one of the speed (or velocity) error and the phase error. For other types of exercise devices having one or more movable members that move through a range of motion, the controller may be configured to adjust the resistance force a plurality of times as the movable member moves through a range of motion.

The predefined criteria may, optionally, permit at least some overlap of speed (or velocity) control and phase control, such that during at least some operating conditions the controller controls the resistance force based on both speed (or velocity) error and phase error.

The predefined criteria may, optionally, be mutually exclusive such that the controller is configured to utilize only speed (or velocity) control or phase control at each point in time during operation of the exercise device or system.

Another aspect of the present disclosure is an exercise device or system comprising a movable input member that moves while a force is applied to the movable input member by a user. The exercise device or system includes a brake or other suitable device that is configured to generate a resistance force that tends to resist movement of the movable input member when a user applies a force to the movable input member. The system or device further includes a controller that is operably connected to the brake. The controller may be configured to control the resistance force to synchronize movement of the movable input member with a music beat utilizing speed (or velocity) error and phase error. The speed (or velocity) error may comprise a difference between a target speed (or velocity) and a measured speed (or velocity), and the phase error may comprise a difference between a target phase and a measured phase. The controller may be configured to increase the resistance force relative to a baseline resistance force when 1) the speed (or velocity) error is caused by the measured speed (or velocity) exceeding the target speed (or velocity); and 2) the phase error is caused by the movable input member being ahead of the target phase. The target speed (or velocity) and/or the target phase are preferably determined, based at least in part, on the music beat.

The controller may, optionally, be configured to utilize phase error to control the resistance force according to predefined phase control criteria.

The controller may, optionally, be configured such that it does not take into account phase error to control the resistance force when the measured speed (or velocity) satisfies predefined criteria.

The controller may be configured such that the measured speed (or velocity) satisfies the predefined criteria when the measured speed (or velocity) is within a predefined range of speeds or velocities.

Another aspect of the present disclosure is a method of controlling an exercise device to synchronize movement of an input member of the exercise device to music beats. The method includes utilizing a music beat to determine at least one of a target phase and a target speed (or velocity). The method further includes utilizing a phase control and a speed (or velocity) control to control a resistance force of a movable member of the exercise device while a force is applied to the movable input member by a user. The resistance force is controlled in a manner tending to cause movement of the movable input member to be synchronized to a beat of the music. The phase control may comprise varying the resistance force in a manner that tends to minimize a difference between a measured phase and the target phase, and the speed (or velocity) control may comprise varying the resistance force in a manner that tends to minimize a difference between a measured speed and a target speed (or velocity).

The method may, optionally, include repeatedly determining if predefined phase control criteria are satisfied while the input member is moving.

The method may, optionally, further include switching from speed (or velocity) control to phase control when the predefined phase control criteria changes from not being satisfied to being satisfied. The method may optionally include switching from phase control to speed (or velocity) control when the predefined phase control criteria changes from being satisfied to not being satisfied.

DETAILED DESCRIPTION

Figure 1:
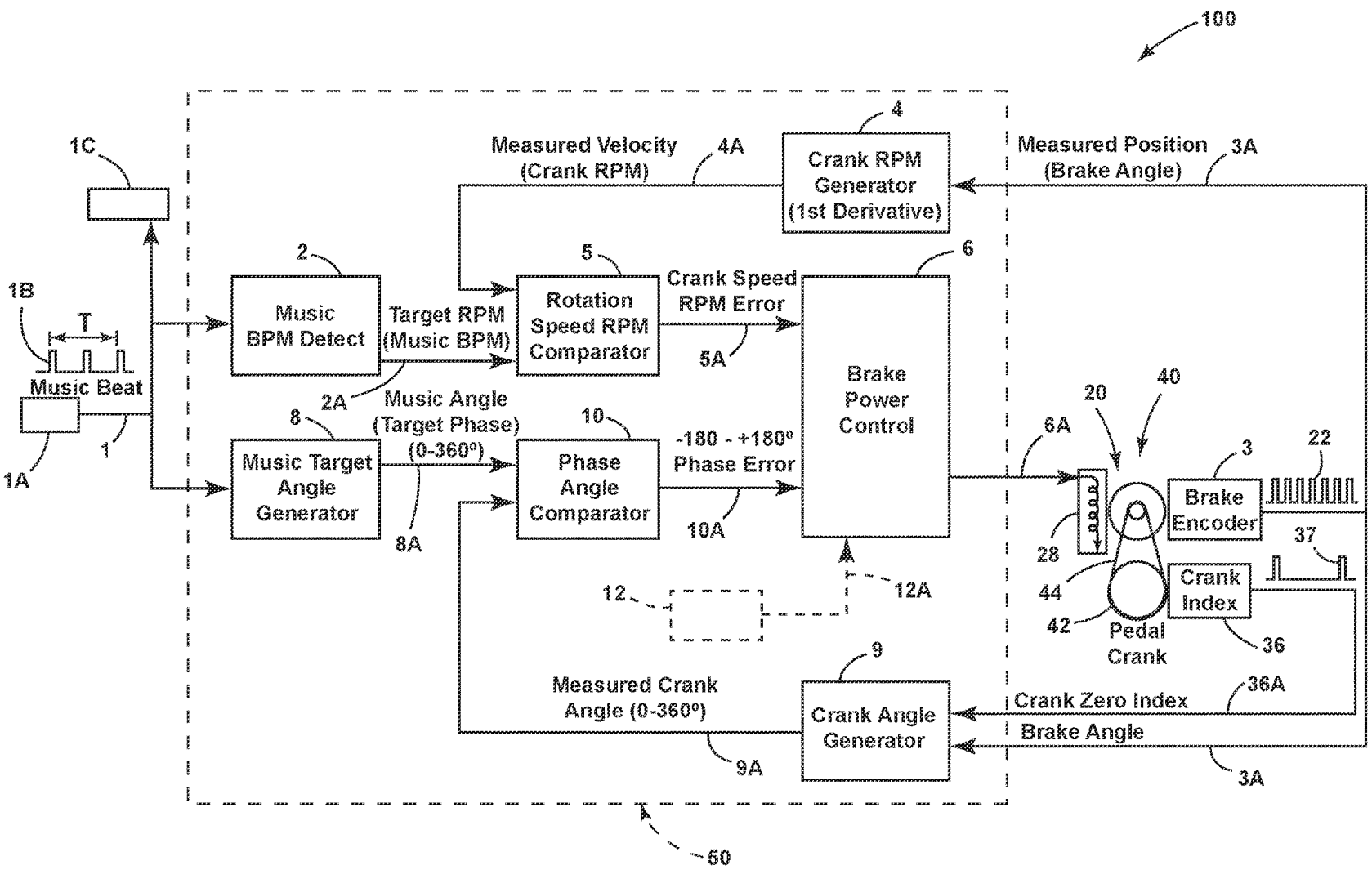
FIG. 1 is a schematic of a system and method according to one aspect of the present disclosure.

For purposes of description herein, the terms "upper," "lower," "right," "left," "rear," "front," "vertical," "horizontal," and derivatives thereof shall relate to the invention as oriented in FIG. 1 However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present application is related to U.S. Pat. No. 7,833,135, issued on Nov. 16, 2010, and entitled "STATIONARY EXERCISE EQUIPMENT," the entire contents of which are incorporated by reference.

With reference to FIG. 1, an exercise device and music synchronization system 100 may include an exercise device 40 (e.g. a stationary bike) and a controller 50 (e.g. a processor or control circuit) that receives an input signal such as an audio signal 1 and sensor inputs such as Brake Angle 3A and Crank Zero Index 36, and outputs a Brake Power Control Signal 6A. It will be understood that controller 50 may be integrated into exercise device 40, or the controller 50 may be located remotely. A system 100 according to one aspect of the present disclosure is configured to control a resistance force of a stationary exercise device 40 in such a way that the frequency of movement of a pedal, handle, or other movable input member by which a user can input or apply a force of a stationary exercise device 40 tends to become synchronized to a music beat 1B (or other repeating feature of the audio signal 1).

The system 100 may be configured to utilize (implement) speed (or velocity) control and phase control. The speed (or velocity) control may optionally comprise isokinetic speed (or velocity) control that varies a resistance force in a manner that encourages a user to maintain a generally or substantially constant speed (or velocity) (e.g. a speed (or velocity) that falls within a predefined range). The speed (or velocity) control may be utilized (implemented) when predefined criteria for phase control is not satisfied. For example, speed (or velocity) control may be utilized when a difference between a Measured RPM 4A and a Target RPM 2A is greater than a predefined range of RPM (e.g. ±5 RPM). Thus, the system 100 may be configured to utilize a phase control when a measured speed (or velocity) (RPM) is within a predefined speed (or velocity) range (e.g. measured RPM is within 5 RPM of Target RPM), and to utilize speed (or velocity) control when the position difference is outside of the predefined capture range (e.g. ±5 RPM). The system 100 may be configured to rapidly and continuously (e.g. one or more times during each movement of an input member through a range of movement) determine if the system meets the phase control criteria and switch between the speed (or velocity) control and phase control to control the exercise device 40. As discussed below, speed (or velocity) control and phase control are not necessarily mutually exclusive, and the system may (optionally) be configured to simultaneously control resistance force based on both speed (or velocity) control and phase control.

It will be understood that the system and method of the present disclosure is not necessarily limited to synchronizing a movable input member to musical beats (stressed and/or unstressed), but rather includes synchronization to virtually any repeating characteristic or pattern, pulse, cadence, tempo, meter, rhythm, grooves, oscillations, or virtually any other type of recurring event or phenomenon of sound or other phenomenon that can be perceived by a user. For example, as discussed in more detail below, one aspect of the present disclosure involves measuring/determining a musical beat and adjusting a resistance force experienced by a user of an exercise device 40 in a manner that tends to cause the user's frequency of movement of one or more body parts (e.g. legs and/or arms) involved in the exercise (and corresponding moving components of the exercise device) to become synchronized to the beat of the music that the user is listening to while performing the exercise. However, input signal 1 could comprise other types of inputs (e.g. lights), and the movements of the exercise device 40 and user could also or alternatively be synchronized to other sources such as flashing lights or other input having a recurring/repeating pattern over time. Also, one or more devices 40 could be synchronized to an input signal that is not necessarily perceived by the user of the exercise equipment. For example, if a particular exercise routine or program requires a user to maintain a particular pace or target velocity (e.g. a target RPM or pedal rate of a stationary bike), the system 100 could be configured to vary the resistance force of a movable member (e.g. pedals) whereby the user experiences significantly reduced resistance if the movable member is moving at a measured speed (or velocity) (e.g. Measured RPM) that is less than the target rate (or target range) and significantly increased resistance if the movable member is moving at a measured speed (or velocity) (e.g. Measured RPM) that is greater than the target (or velocity). Also, as discussed below in connection with FIGS. 3 and 4, the degree to which the resistance force is increased and/or decreased based on a difference between measured and target speed (or velocity) and/or phase can be adjusted or controlled to provide a minimal synchronization effect or to provide a very pronounced or strong synchronization effect. For example, the resistance force could drop to zero (or close to zero) (or powered assist could be provided if required) if the measured speed (or velocity) (e.g. Measured RPM) drops below the target speed (or velocity) (e.g. BPM), and the resistance force could increase to a very high force level (e.g. greater than a maximum force a user is capable of generating) if the measured speed (or velocity) (e.g. Measured RPM) is above the target speed (or velocity) (e.g. BPM). Less pronounced increases and decreases in the resistance force may be utilized to provide a less pronounced synchronization effect.

Exercise device 40 may include a movable input member such as pedal crank 42 that is (optionally) operably connected to a variable resistance device 20 by a drive system 44. Variable resistance device 20 may comprise an alternator or DC motor that provides a variable resistance force acting on the movable input member 42. As discussed in more detail below, the resistance force provided by variable resistance device or brake may be controlled by a resistance force signal 6A from controller 50. Variable resistance device 20 may optionally include a flywheel or other inertia member that simulates, at least partially, the effects of momentum experienced by a user on, for example, a road bike. Although a flywheel may be utilized, a flywheel is optional, and it is not necessarily required. If a flywheel is utilized, the resistance force experienced by a user will generally include forces resulting from the flywheel friction of the moving components of device 40 as well as resistance forces due to variable resistance device 20.

Variable resistance device 20 may comprise virtually any device or mechanism that is capable of providing variable resistance based on a control input or signal. For example, variable resistance device 20 may comprise a friction brake mechanism, an eddy current mechanism, or other mechanism that is capable of being controlled to provide a variable resistance force acting on movable input member 42. Drive system 44 may comprise one or more chains, belts, shafts, links, sprockets, pulleys, gears, etc. that transmit force between variable resistance device 20 and movable input member 42. Drive system 44 may have a fixed drive/gear ratio, or drive system 44 may have a variable drive/gear ratio. It will be understood that the drive system 44 is optional, and variable resistance device 20 may act directly on movable member 42.

The system 100 may be configured to utilize both speed (or velocity) control and phase control to synchronize movement of a component of an exercise device 40 to a music beat 1B. For example, when a user initially begins to apply force to a pedal crank 42, the system 100 may utilize constant speed (or velocity) control until the measured speed (or velocity) (RPM) of pedal crank 42 is sufficiently close (e.g. ±5 RPM) to a Target RPM (e.g. Music BPM 2A). The system 100 may then utilize phase control to maintain the phase at the target phase. In general, the phase control also tends to maintain the measured speed (or velocity) (RPM) at the target speed (or velocity) (RPM). It will be understood that the phase control may comprise a phase-locked loop control, or it may more generally comprise phase control tending to synchronize device 40 to a music beat or other repetitive input.

With reference to FIG. 1, an input such as audio signal 1 having a music beat 1B is supplied to the system 100 (electronics) by a source 1A as a series of music beat pulses, typically one pulse per music beat. It will be understood that each beat may comprise more than one pulse (e.g. alternating loud and soft sounds). Source 1A may comprise, for example, a smartphone or other suitable computer or music-playing device. For example, a user may listen to music from an electronic storage/receiving device (e.g. smartphone) while exercising, and this music may also be utilized as an input (e.g. audio signal 1) into the system. The music (or other recurring pattern) may be supplied from other sources. For example, in a group exercise class, a plurality of stationary bikes or other suitable exercise devices may be used simultaneously by a plurality of users who are all listening to the same music, and the exercise devices utilized in the class may all receive the same music (or other beat control input) to thereby synchronize the exercise devices in the class to the same music or other input.

Referring again to FIG. 1, the synchronization control may be implemented by a suitable computing device such as a controller 50 (e.g. a processor) which receives a signal 1 (e.g. an audio signal) from a source such as music source 1A. Controller 50 may comprise one or more processors and/or circuits and/or other electronics. Thus, as used herein, "controller" is not limited to any specific type or arrangement of hardware and/or software. As discussed in more detail below, audio signal 1 is utilized to determine a Music BPM or Target RPM 2A for speed (or velocity) control (e.g. isokinetic constant speed control) or mode during initial start-up/use of exercise device 40, and audio signal 1 is also utilized to determine a Music (Target) Angle 8A for a phase control of exercise device 40. Phase control may be utilized when the speed (or velocity) (e.g. measured RPM) of a movable input member 42 meets predefined phase control criteria (e.g. the measured speed (or velocity) falls within a predefined range).

Controller 50 analyzes the incoming signal 1 to distinguish/detect the music beats 1B to determine both a Target RPM 2A (target speed (or velocity)) and a Target Angle 8A (target phase). At start-up, the system 100 may be configured to determine the music beat frequency in Beats Per Minute (BPM) or other unit of time to determine an average BPM (shown schematically at Music BPM detect 2) before a user begins to exercise. Music BPM detect 2 may comprise, for example, an algorithm that is utilized (implemented) by controller 50. Alternatively, Music BPM detect 2 may determine Music BPM in real time (i.e. without delay, or with very small delay on the order of a fraction of a second) while the audio signal 1 is supplied to a sound generation device 1C (e.g. speakers, ear buds, etc.) whereby the user hears the music being played. Various beat detection algorithms/programs have been developed, such that a detailed description of this aspect of the present disclosure is not believed to be necessary.

When a user is operating the equipment 40 (e.g. a stationary bike) using a movable input member such as a pedal crank 42 (in the case of a stationary bike), a sensor such as a Brake Encoder 3 may be used to detect the position and/or movement (e.g. speed (or velocity)) (RPM) of a movable component such as brake/flywheel (variable resistance device 20) that is operably connected to pedal crank 42 by a drive system 44. The gear (drive) ratio of drive system 44 is known, and the position and speed (or velocity) of pedal crank 42 can therefore be measured directly or determined using signals (data) from sensor 3. The position signal 22 generated by sensor/encoder 3 may be utilized for both speed (or velocity) and phase control. Specifically, the speed (or velocity) (Measured Velocity 4A) may be determined by Crank RPM Generator 4. Crank RPM Generator 4 may comprise, for example, an algorithm that is utilized (implemented) by controller 50. Crank RPM Generator 4 may utilize the measured position (brake angle) 3A and the corresponding time stamp to determine Measured Velocity (Crank RPM) 4A. Numerous ways to determine/measure velocity utilizing position sensors are known, and the present disclosure is not limited to any specific sensor or technique. Also, as used herein, the terms Measured Velocity and Measured RPM may refer to velocity or speed that is measured directly, or velocity or speed that is determined from changes in measured position over time (e.g. a first derivative of position with respect to time).

Measured Crank Angle 9A is determined by Crank Angle Generator 9. Crank Angle Generator 9 may comprise, for example, an algorithm that is utilized (implemented) by controller 50. Measured Crank Angle 9A comprises a measured position that may be utilized for phase control. Other types of measured positions may be utilized if device 40 includes other types of movable members (e.g. handles or foot supports of an elliptical machine, steps of a stair climbing machine, a seat and/or handle of a rowing machine, etc.). Various types of sensors 3 may be utilized to measure position and/or speed (or velocity), and the present disclosure is not limited to an encoder. Also, sensor 3 may be configured to detect motion of virtually any movable component in the system or device 40 that moves when a movable input member (e.g. pedal crank 42) moves.

Sensor 3 generates a signal 22 which may be in the form of measured position data 3A (e.g. "Brake Angle") paired with time data (e.g. a "time stamp"), which can be utilized to determine a measured speed (or velocity) (e.g. Crank RPM 4A) by dividing change in position by change in time at Crank RPM Generator 4. A processor 50 or other suitable computing device may be utilized to convert the position data 3A into measured speed (or velocity) (Crank RPM 4A). The measured speed (or velocity) may be in the form of Crank RPM 4A, which is determined (e.g. by controller 50) utilizing the chain/pulley ratio of drive system 44, which relates the measured speed (or velocity) (Crank RPM 4A) to the Brake Velocity (RPM).

Rotation Speed Comparator 5 may comprise, for example, an algorithm that is utilized (implemented) by controller 50. The system (e.g. the processor 50) may be configured to compare measured speed (or velocity) (Crank RPM 4A) to a target speed (or velocity) (RPM) determined from the Music Beat Frequency (BPM) 2A to determine a speed (or velocity) (e.g. Crank Speed Error RPM 5). The speed (or velocity) may comprise a difference in speed (or velocity) (RPM) between a target speed (or velocity) and a measured speed (or velocity) (RPM). Rotation Speed Comparator 5 may double the Music BPM 2A to determine a target speed (or velocity) (i.e. Target RPM=2 (Music BPM)) prior to comparison to the measured speed (or velocity (Crank RPM 4A) to provide for one leg stroke per music beat. Alternatively, the Music Beat frequency (BPM) 2A utilized at Rotation Speed Comparator 5 may (for example) be equal to the measured speed (or velocity) (Crank RPM 4A) to provide for two leg strokes per music beat. The number of leg strokes per music beat is, however, not limited to one or two, and virtually any number of leg strokes per music beat may be utilized. For example, if the music has a very rapid beat, multiple beats per leg stroke may be required to provide a suitable leg stroke rate.

Figure 3:
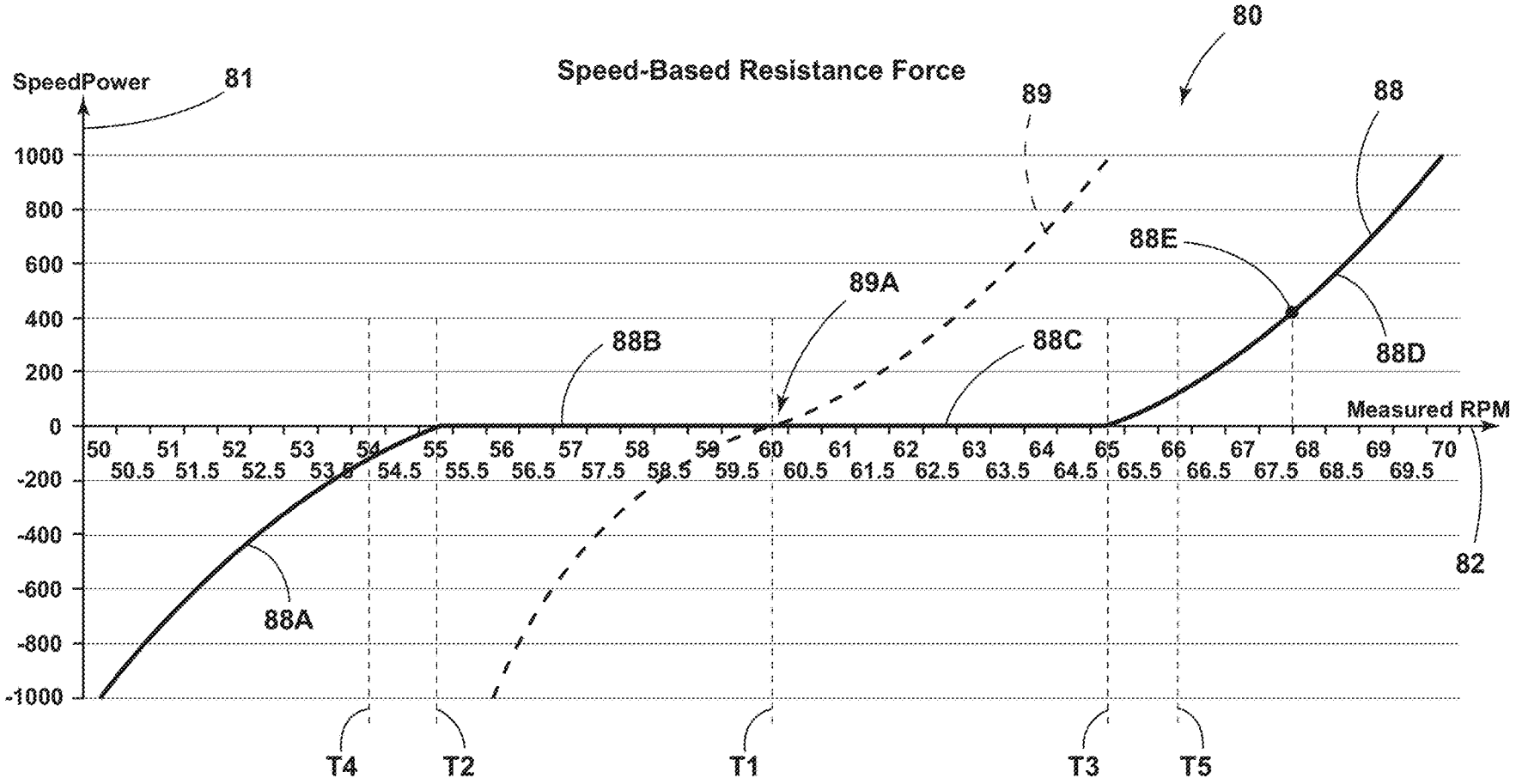
FIG. 3 is a graph showing resistance force (SpeedPower) as a function of measured speed (RPM)

The comparison performed at Rotation Speed Comparator 5 generates a speed (or velocity) error signal designated Crank Speed Error RPM 5A. Error signal 5A is processed by a Brake Power Control step or feature 6. Brake Power Control 6 may comprise, for example, an algorithm that is utilized (implemented) by controller 50. Specifically, Brake Power Control 6 generates a Brake Power Signal 6A that is supplied to brake 28. Brake Power Signal 6A may include speed (or velocity) and/or phase control features. As discussed below in connection with FIG. 3, isokinetic (constant) speed control provides a resistance force tending to maintain a constant speed (Crank RPM) regardless of the force applied to movable input member 42. Brake 28 varies a resistance force (braking power) tending to cause the measured speed (or velocity) (Crank RPM 4A) to match (to the extent possible or within a predefined tolerance range) the target speed (or velocity) (RPM), which is determined from the Music BPM 1B as discussed above. In general, the controller 50 is configured to increase and decrease resistance (braking force) applied by brake 28 as required to minimize speed (or velocity) error (Crank Speed RPM Error), thereby causing the measured speed (or velocity) (Crank RPM 4A) to stay within a predefined range (e.g. ±5 RPM) relative to the target speed (or velocity) (RPM). Thus, isokinetic (constant speed) control may be configured to provide constant or approximately constant measured speed (or velocity) (Crank RPM 4A) (within a predefined tolerance range) to the extent possible within the capability of the device 40 and user.

In use, once the speed (or velocity) control (e.g. isokinetic control) brings the measured speed (or velocity) (Crank RPM 4A) sufficiently close to the target speed (or velocity) (RPM) (due to or resulting from braking), the system (controller 50) determines if the speed (or velocity) difference (e.g. RPM Error 5A) between the measured speed (or velocity) (e.g. Crank RPM 4A) and the target speed (or velocity) (e.g. target RPM 2A) satisfies (meets) predefined criteria for phase control. If the phase control criteria is satisfied, Brake Power Control 6 switches operation from speed (or velocity) (e.g. isokinetic) control to phase control. The phase control criteria may comprise a difference (Error 5A) between measured speed (or velocity) (e.g. Crank RPM 4A) and the target speed (or velocity) (RPM) (Music BPM 2A) that is less than or equal to, for example, 5 RPM (or 1 RPM, 2 RPM, 3 RPM, 4 RPM, 10 RPM, or any other suitable criteria).

The audio signal 1 (including music beat 1B) may also be applied (supplied) to a Music Angle Predictive Generator step or feature 8. Music Angle Predictive Generator step or feature 8 may comprise, for example, an algorithm that is utilized (implemented) by controller 50. The Music Angle Predictive Generator 8 analyzes the period "T" of the incoming music beats 1B and generates a Target Music Angle signal 8A, which may be in the range of 0-360 degrees, in synchronization with the music beat 1B. This correlates Music Beat 1B to position (e.g. crank angles) and creates a target position (e.g. Crank Target Angle 8A). Crank Target Angle 8A may be expressed in, for example, degrees or radians. In general, the calculated target position (e.g. Angle) will be accurate if the rider pedals at the same rate on each pedal stroke.

It will be understood that, in the case of a stationary bike, there are preferably 180 degrees of crank angle between each music beat because the rider (user) has two legs (i.e. the Target Music Angle Signal 8A is 180 degrees). As discussed above, Target Angle 8A is a target position. In the case of a stationary bike, the Target Angle 8A may comprise, for example, bottom center position of each Crank Pedal. The Target Angle (position) has a corresponding time associated with it based on the Music BPM such that the Phase Error is zero if each pedal is at the Target Angle (e.g. bottom center crank position) at the target time associated with the Target Angle (e.g. at the time a music beat occurs).

The number of degrees between each music beat may vary with the number of leg strokes per music beat. For example, if the Music 1 has a very fast beat, the Target Music Angle may be based on two beats per rotation of each pedal. The Target Music Angles could be at top center and bottom center of the pedal rotation, or a single Target Music Angle (e.g. bottom center) may be utilized, and two music beats could occur for each Target Music Angle. Also, for exercise devices such as rowing machines having a single moving input member, the number of degrees between each beat could be either 180 degrees or 360 degrees. If the time required to complete a movement (e.g. a rowing movement) exceeds the time (period) between beats, the number of beats per movement may be adjusted. For example, in the case of a rowing machine, the target positions may comprise the starting and end positions, and three beats may be required for the first half (extension) of the rowing movement, and two beats may be required for the second half (return) of the rowing movement (if the extension movement requires more time than the return movement). Alternatively, the target position could comprise, for example, the starting position of a rowing machine, and the target position (phase) may comprise the starting position at the time of a music beat. In this example, the Phase Error 10A comprises the difference between measured position at the time a beat occurs and the target position. Thus, the number of beats per exercise movement may be adjusted as required based on the Music BPM and/or the desired frequency of movement for a particular exercise device.

Brake Encoder 3 may be configured to supply a high resolution brake angle signal 22 to the processor 50. If signal 22 is a relative position signal rather than an absolute position signal, a crank index 36 may be utilized. Crank index 36 generates a signal 36A corresponding to a known pedal (crank) position (e.g. signal 36 may comprise a pulse that is generated each time crank 42 is at an angle of zero degrees). Crank Angle Generator 9 utilizes the signals 3A and 36A to determine an absolute Measured Crank Angle 9A in degrees. If sensor 3 comprises an absolute position sensor, Crank index 36 and Crank Angle Generator 9 are typically not required.

An encoder (sensor) and an index sensor could both be operably connected to the movable input member or crank 42. Nevertheless, the preferred implementation described above may provide a more practical production solution. In one example, signal 22 comprises 250 pulses per crank revolution from an encoder 3 on the brake providing 25 readings per revolution, and the gear ratio between the crank 42 and the brake is 10:1. Therefore, 25×10 is 250 pulses per crank revolution. This permits the angular location (position) of the crank 42 to be determined in degrees. In this example, 360/250 yields a reading every 1.44 degrees. An encoder with more than 25 readings per brake revolution may be used to provide higher resolution. It will be understood that virtually any suitable sensor, device or method may be utilized to measure and/or determine position and/or speed (or velocity) of a movable member, and the present disclosure is not limited to the specific examples described herein.

The Target Music Angle 8A (corresponding to the target crank position) is compared to Measured Crank Angle 9A by the Phase Angle Comparator 10, preferably both before and after each Target Music Angle 8A. Phase Angle Comparator may comprise, for example, an algorithm that is utilized (implemented) by controller 50. In general, the system is configured to cause the pedal positions to be synchronized with the beat of the music to the extent possible, whereby the target and measured phases are equal. In general, the phases are equal if the movable member (e.g. crank 42) is at a target position at the time associated with the target position. The Phase Angle Comparator 10 generates a Phase Error 10A in degrees (if device 40 comprises a stationary bike). In general, the phase error 10A may be proportional to a difference between the target position (Target Music Angle 8A) and the measured position (Measured Crank Angle 9A) measured at the time associated with the target position (Target Music Angle 8A). The Phase Error 10A is utilized by the Brake Power Control 6 to provide phase control when the criteria for phase control is satisfied. As discussed in more detail below in connection with FIG. 4, the Brake Power Control 6 uses phase control to increase and decrease the brake resistance force to maintain the measured position (Crank Angle 9A) in phase with the target position (Target Music Angle 8A), which corresponds to Music Beat 1B. If the measured position (angle) of crank 42 is ahead of the desired (target) position relative to the music beat, more brake power (force) is applied to slow the crank 42. If the measured position (Crank Angle 9A) is behind the desired (target) position (Target Music Angle 8A), the brake power (force) of brake 28 is decreased.

Figure 2:
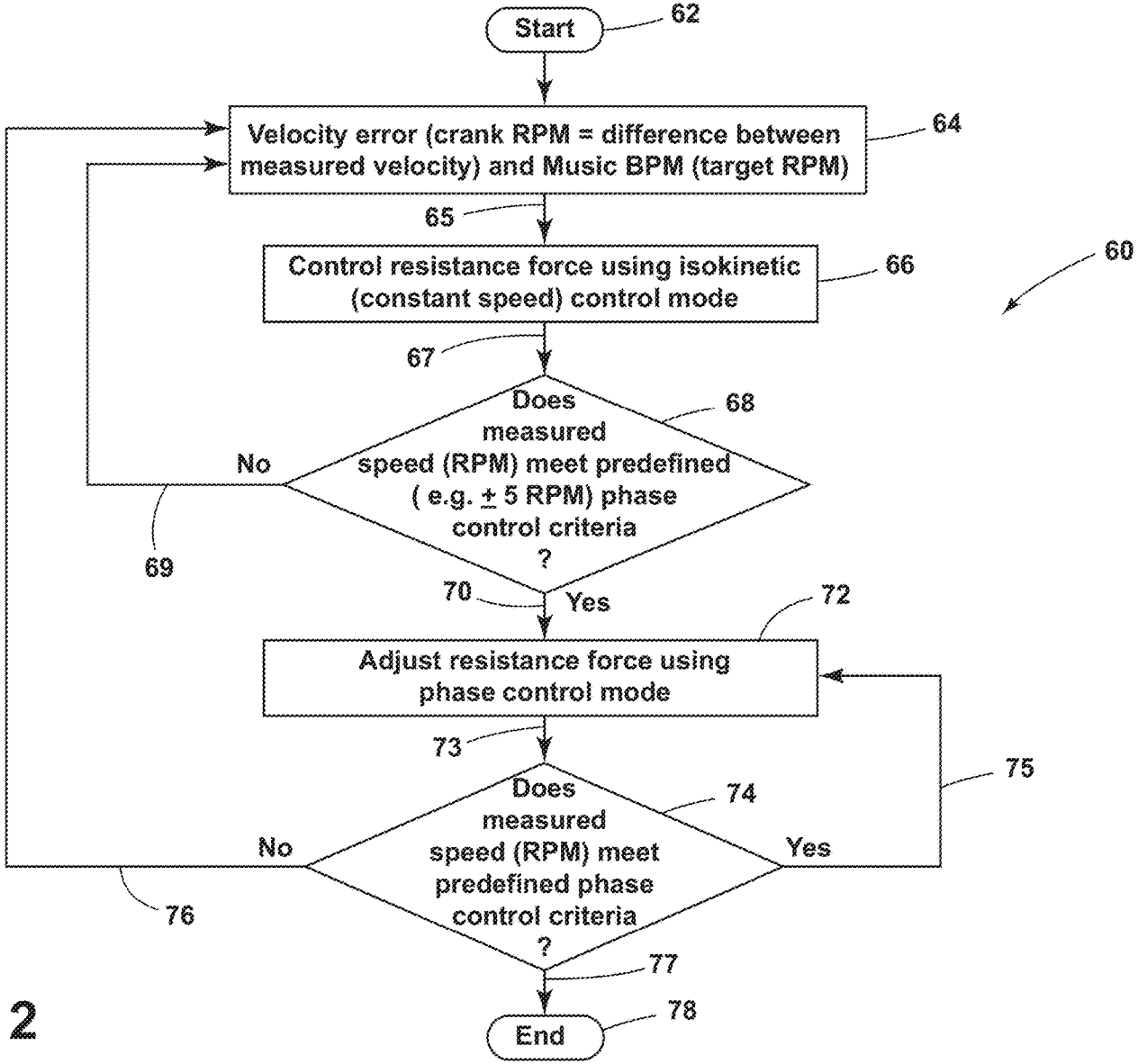
FIG. 2 is a flow chart showing music synchronization according to one aspect of the present disclosure.

With further reference to FIG. 2, a flow chart 60 shows operation of equipment 40. Initially, at start 62, a user begins to use the equipment 40 (e.g. by moving crank 42). At step 64, the system (e.g. controller 50) determines a Velocity Error by comparing a Target RPM to a Measured RPM. In general, the Velocity Error of FIG. 2 corresponds to the Crank Speed RPM Error 5A of FIG. 1.

At step 66, the system controls the resistance force of movable input member (e.g. crank 42) using isokinetic (constant speed) control mode. As discussed above, the isokinetic control mode tends to bring the Measured Velocity (e.g. Crank RPM 4A) equal to a Target Velocity.

At step 68, the system determines if the measured speed (e.g. Crank RPM 4A) meets predefined phase loop control criteria. As discussed above, this criteria may comprise, for example, a Measured RPM that is within a specific RPM (e.g. 5 RPM) of a Target RPM. However, it will be understood that the phase control criteria may comprise other criteria. If the measured speed does not meet the phase control criteria, control returns to step 64 as shown by the line 69. If the measured speed does meet predefined phase control criteria, the process continues to step 72 as shown by the arrow 70.

At step 72, the resistance force is adjusted or controlled using a phase control mode. As discussed above, the phase control decreases resistance if the movable member 42 lags behind a target position, and increases resistance force if a measured position is ahead of the target position. This tends to bring the phase of the moving member 42 into phase with the Music Beat such that movable member 42 is at a specific position at a specific time to thereby synchronize the movable member with the beat of the music.

The process then continues to step 74 as shown by the arrow 73. At step 74, the system again determines if the measured speed meets predefined phase control criteria. If the phase control criteria is met, the system continues to adjust resistance force using the phase control as shown by the line 75. However, if the measured speed does not meet the phase control criteria at step 74, the system returns to step 64 as shown by the line 76, and the system then utilizes isokinetic control mode (step 66) until the system again meets the phase control criteria at step 68.

A user may stop using the device 40 as shown by the line 77 and the "END" step or state 78.

As discussed below in connection with FIGS. 3 and 4, the phase control criteria is not necessarily mutually exclusive with respect to speed control (e.g. constant speed control) and the Brake Control Signal 6A may comprise the sum of speed control (FIG. 3) and phase control (FIG. 4) components or variables, and may further include a sum (integral) of speed and phase error. Brake Control Signal 6A may (optionally) further include additional resistance force components (e.g. momentum simulation components) in addition to the speed and phase based components.

It will be understood that FIG. 2 is schematic in nature, and the controller 50 does not necessarily implement the steps in the sequence shown in FIG. 2. Rather, FIG. 2 illustrates some of the general concepts involved in operation and control of the system.

Figure 4:
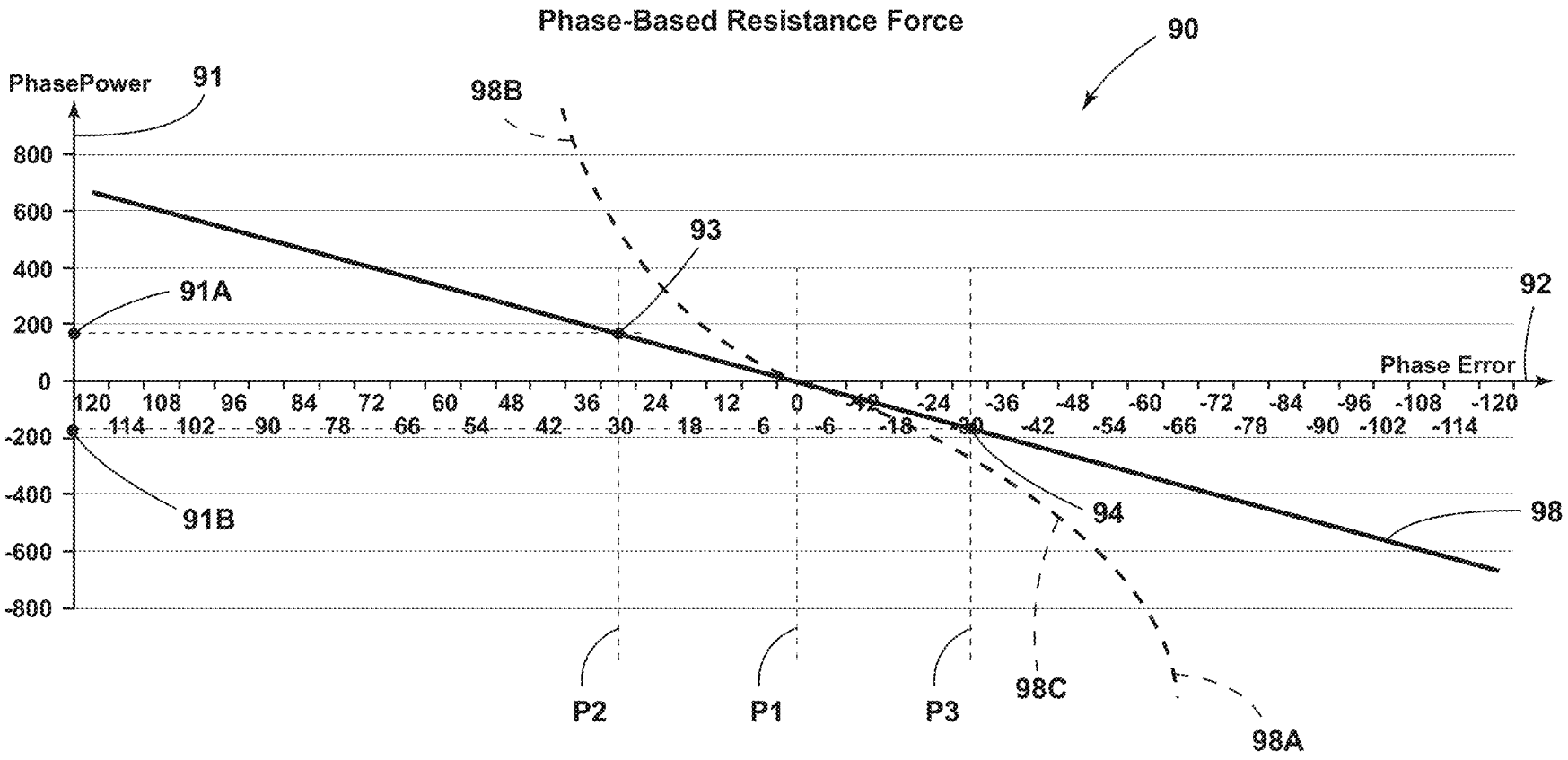
FIG. 4 is a graph showing resistance force (PhasePower) as a function of phase error.

The total resistance force of brake 28 may comprise the sum of a speed-based control (FIG. 3) and phase-based control (FIG. 4). Differences in speed (FIG. 3) and differences in phase (FIG. 4) generally correspond to proportional control "P" in a PID controller. As discussed in more detail below, controller 50 may, optionally, be configured to integrate the sum of speed and phase differences to provide integral ("I") control in addition to the speed and phase-based difference control. Controller 50 may, optionally, be configured to utilize a derivative ("D") control in addition to the P and I control features. Controller 50 may be configured to provide a control signal 6A to brake 28 that is proportional to the sum of 1) a speed error (FIG. 3), 2) a phase error (FIG. 4), and 3) an integral of the speed and phase errors.

With further reference to FIG. 3, graph 80 illustrates one example of a speed (or velocity) control having resistance force that varies as a function of Measured RPM. Vertical axis 81 represents a resistance level control variable (SpeedPower) utilized to control brake 28 (FIG. 1), and horizontal axis 82 represents a Measured Crank RPM (e.g. Crank RPM 4A; FIG. 1). The vertical axis may comprise the magnitude of a variable (SpeedPower) that is utilized by controller 50 to generate a control signal (e.g. signal 6A, FIG. 1) to brake 28. In FIG. 3, the target speed (or velocity) (target RPM) RPM is set at 60 RPM (vertical line T1), and the criteria for implementing speed (isokinetic) control comprises a measured speed (or velocity) RPM that is within ±5 RPM of the target speed (or velocity) (RPM) T1. Thus, controller 50 sets the value of the SpeedPower variable (vertical axis) as shown by the line 88 based on measured speed (RPM) (horizontal axis). For example, if the measured RPM is 68, controller 50 sets the value of the SpeedPower variable at 400, the value of the vertical axis where a vertical line through 68 on the horizontal axis intersects line 88 (i.e. point 88E). During operation, controller 50 may continuously and rapidly (e.g. once per second, 10 times per second, 100 times per second, 1,000 times per second, or more) update the value of the SpeedPower variable using measured RPM and the function represented by line 88. In general, line 88 corresponds to the component or portion of the resistance force generated by brake 28 as a function of the measured speed (or velocity) (RPM). As used herein, "Brake Power" and "SpeedPower" generally refer to control variables utilized by controller 50 to generate control signal 6A to brake 28 that cause brake 28 to adjust and/or control a resistance force applied (directly or indirectly) to movable member 42 by brake 28. It will be understood that the actual force required to move movable member 42 may vary somewhat due to friction of the moving components of device 40, inertia of moving member 42 and flywheel (if present), etc.

In the illustrated example, the line 88 includes line segments 88A-88D. If the measured speed (or velocity) (RPM) is below 55 RPM, the speed-based component of the resistance force (SpeedPower) varies as a function of speed (or velocity) (RPM) as shown by the line segment 88A. If the device 40 includes a motor (e.g. if brake 28 comprises an electric motor) that is capable of providing an assistance force to move the input member 42, the resistance force (SpeedPower variable) may have a negative value as shown by the line segment 88A. If the phase error (FIG. 4) is zero (or negative) and the speed error (FIG. 3) is also negative, control signal 6A (FIG. 1) may be negative, and the motor of device 40 may assist rotation of the movable member 42. However, if device 40 does not include a motor capable of providing power-assist, controller 50 may be configured to set the signal 6A to zero whereby the resistance of brake 28 is zero whenever the speed and phase control would otherwise result in a negative resistance force signal. Thus, in the illustrated example, if the device 40 does not include a motor and if the phase resistance and integral of speed and phase error are both zero or negative, the resistance force due to speed error will be zero when the Measured RPM is less than 55, not negative as shown in FIG. 3.

If the measured speed (or velocity) (RPM) is within the ±5 degrees of the target speed (or velocity) (RPM) (i.e. 60 RPM in the illustrated example), the resistance force due to speed error (SpeedPower) is zero. Thus, when the measured speed (or velocity) (RPM) corresponds to the line segments 88B or 88C, the controller sets the SpeedPower resistance force variable to zero, and the brake 28 does not generate any resistance force.

However, if the Measured RPM exceeds the upper bound of the isokinetic range (i.e. the Measured RPM exceeds 65 RPM), the controller 50 provides increasing resistance (SpeedPower) due to speed error as shown by the line segment 88D. Thus, if a user is outside of the Target RPM range between T2 and T3, the controller provides increased resistance to thereby urge the user to reduce RPM to bring the RPM back within the target range.

Line 88 represents one possible approach to control resistance force based on measured speed (or velocity). In the example of FIG. 3, the zero resistance force between the RPM limits T2 and T3, and the variable resistance force outside of the limits T2 and T3 form a constant speed (or velocity) (isokinetic) control. Although this type of speed-based control is generally preferred, the resistance force between limits T2 and T3 could be non-zero such that the speed-based control is not purely constant speed (i.e. not purely isokinetic). For example, line segments 88B and/or 88C could be sloped somewhat. Alternatively, a curved line 89 could be utilized. Curved line 89 could be, for example, sinusoidal with a central portion or point 89A that is tangential to horizontal axis 82 at the point where line 89 crosses axis 82.

It will be understood that the target speed (RPM) of 60 in FIG. 3 is merely an example of one possible target speed (RPM). In general, the target speed (RPM) is set based on the Music Beat. Also, the upper and lower bounds T2 and T3 of the Target RPM range shown in FIG. 3 are merely an example of one possible constant speed (RPM) criteria. The speed-based control criteria could comprise virtually any range of speeds (velocities) as required for a particular application. If the exercise device 40 comprises a stationary bike or cycle trainer, the speed (RPM) upper and lower bounds may comprise ±1 RPM, ±2 RPM, ±3 RPM, ±4 RPM, ±5 RPM, ±10 RPM, or virtually any other range of RPMs. If device 40 does not include a powered assist motor, the RPM range does not require a lower bound.

It will be understood that the shapes and slopes of the line segments 88A and 88D in FIG. 3 may vary as required and/or to provide different levels or degrees of constant speed (e.g. isokinetic) control. For example, if the slope of the line segments 88A and 88D is increased, the speed control will become more pronounced, and it will be more difficult for a rider to exceed the upper bound T3 of the speed (or velocity) (RPM) range. Conversely, the slope of the lines 88A and/or 88D may be decreased to provide a more gradual transition from line segment 88A to line segment 88B and/or from line segment 88C to line segment 88D. For example, the transition from line segment 88C to line segment 88D in the region of the upper RPM bound T3 may comprise a smooth curve such that the user does not experience an abrupt increase in resistance force as the upper bound T3 is crossed due to the speed (or velocity) (RPM) exceeding the upper bound T3. Similarly, the transition between line segments 88A and 88B in the vicinity of lower RPM bound T2 may also comprise a smooth curve to avoid an abrupt change in resistance force at the lower RPM bound T2.

As discussed below, the RPM bounds T2 and T3 may comprise phase control criteria, and the system (e.g. controller 50) may be configured to implement phase control (FIG. 4) only when the RPM is between the upper and lower bounds. Alternatively, controller 50 may be configured to utilize the sum of the speed and phase control variables (i.e. the value of each control variable (vertical axis in FIGS. 3 and 4) corresponding to the point where a vertical line through the measured variable (horizontal axis) intersects line 88 or 98, respectively. Restated, controller 50 may be configured to determine the numerical value of the SpeedPower control variable using measured RPM and the function (line 88) of FIG. 3, and to determine the numerical value of the PhasePower variable using the measured phase error and the function (line 98) of FIG. 4, and add the numerical values of the SpeedPower and PhasePower variables to provide a first control variable that is the sum of the SpeedPower and PhasePower variables. Controller 50 may also be configured to integrate the first control variable over time to provide an integral ("I") value that may be added to the first control variable to form a second control variable that takes into account speed error, phase error, and the accumulated speed and phase errors over time. The sum of the SpeedPower and Phase Power variables may be continuously integrated, or separate integrals may be taken of the SpeedPower and PhasePower variables. For example, the integration may start when a user initially starts using device 40 and continue during operation, or the integration for PhasePower may restart for each pedal revolution to avoid carrying over accumulated phase error for multiple revolutions. Alternatively, or in addition, the magnitude of the phase error integral may be numerically limited to avoid excessive error accumulation (e.g. if integration begins at startup of device 40).

With further reference to FIG. 4, graph 90 illustrates a resistance force variable ("PhasePower") as shown by the line 98. "PhasePower" may comprise a variable that is calculated by controller 50 to determine a Brake Control Signal 6A (FIG. 1) sent to brake 28. Brake Power Signal 6A may comprise the sum of a SpeedPower variable (FIG. 3) and a PhasePower variable (FIG. 4). The Brake Power Signal may further comprise a time integral of the sum of the SpeedPower and PhasePower variables (i.e. controller may be configured to provide "PI" control).

Vertical axis 91 of FIG. 4 represents a numerical value of resistance force generated by brake 28 (i.e. controller 50 causes brake 28 to generate a resistance force corresponding to the PhasePower variables). The horizontal axis 92 of FIG. 4 represents the difference (error) between the Target Phase Angle "P1" and the Measured Crank Angle. Controller 50 may be configured to rapidly and continuously calculate (update) the PhasePower variable utilizing the function of line 98 and the phase error. When the Measured Crank Angle is equal to the Target Phase Angle, the Phase Error 98 (e.g. Phase Error 10A; FIG. 1) is zero as represented by the vertical line "P1." If, for example, exercise device 40 comprises a stationary bike, the phase-based resistance (PhasePower) will be zero when the Phase Error is zero (i.e. the pedals are at a target position and corresponding target time such that the pedals are at a predefined position when a music beat occurs). However, if the phase of crank 42 is ahead of the Target Phase Angle (i.e. to the left of the line P1), the PhasePower will increase, thereby tending to shift the phase of the crank 42 back to the Target P1. Conversely, if the phase of the crank 42 is behind the Target Phase, the PhasePower is reduced as shown by the portion of line 98 to the right of the vertical line P1. For example, if the crank phase is 30 degrees ahead of the Target Phase (line "P2"), the resistance force (PhasePower) will be set at a value 91A (e.g. about 150) corresponding to a point 93 at which line P2 intersects line 98. Conversely, if the measured crank phase is 30 degrees behind the Target Phase as shown by the line P3, the resistance force (PhasePower) will be set at a value 91B (approximately −150) corresponding to the point 94 at which vertical line P3 intersects line 98.

The zero resistance force level of vertical axis 91 of FIG. 4 may represent an actual zero force level, in which case the line 98 to the right of line P1 does not extend below the horizontal axis 92, but rather extends horizontally along the horizontal axis 92. However, the zero resistance level of vertical axis 91 may, alternatively, comprise a baseline resistance force (nominal zero). For example, the exercise device 40 may have a baseline resistance force that is non-zero even when the Measured Phase is exactly equal to the Target Phase (e.g. line P1; FIG. 4) and when the Measured RPM is equal to the Target RPM (e.g. line T1; FIG. 3). In this case, the line 98 may extend below the horizontal axis 92 of FIG. 4 to reduce the force if a user falls behind the desired phase position to thereby reduce the total resistance force experienced by a user to assist in causing the movable member (e.g. crank 42) to move back to an in-phase condition with respect to the Target Phase.

In FIG. 4, the phase resistance line 98 extends between 120 and −120 degrees. In general, the phase control line may extend further (e.g. ±180 degrees or more) to thereby provide increasing and/or decreasing resistance up to a predefined out-of-phase maximum.

In FIGS. 3 and 4, the resistance level zero may represent a baseline resistance (i.e. nominal zero) rather than an actual total resistance level. For example, if device 40 comprises a stationary bike, the bike may, optionally, be configured to provide a non-zero baseline resistance force such that the user experiences some resistance force even if the RPM is between bounds T2 and T3. Also, device 40 may include a user input feature that allows the user to select/adjust a baseline resistance level (e.g. a range of 0-10), and the resistance force of FIG. 3 may be added to the baseline resistance force. In this example, a highly trained user could select a higher baseline resistance level (e.g. 8 or 9) and a user having lower capability may select a lower baseline resistance level (e.g. 0 or 1). In this example, the nominal zero (baseline) force resistance level in FIG. 3 (i.e. line segments 88B and 88C) may nevertheless result in a significant total resistance level if a higher baseline resistance is selected by a user. Conversely, the "0" resistance level of FIG. 3 (line segments 88B and 88C) may result in a total resistance zero if a user selects a force of baseline resistance of zero (or if the device does not permit setting a non-zero baseline). If a user selects a baseline resistance level that is significantly greater than zero, the line segment 88A may represent a resistance force that is subtracted from the baseline resistance force. In this case, the total resistance force experienced by a user will be reduced if measured RPM is below lower RPM bound T2.

Also, if the speed-based resistance force (FIG. 3) is non-zero at a given point in time, controller 50 may be configured to reduce the total resistance force of control signal 6A if the PhasePower variable is negative at that point in time. Conversely, if the PhasePower variable (FIG. 4) is positive at a point in time at which the SpeedPower variable (FIG. 3) is negative, the total resistance force of signal 6A may comprise the sum of the SpeedPower and PhasePower variables. Also, as discussed above, the control signal 6A to brake 28 may further comprise an integral over time of the sum of the SpeedPower and PhasePower variables. Thus, because the total resistance force (signal 6A) may comprise the sum of the SpeedPower and PhasePower variables (and optionally an integral or derivative of the SpeedPower and/or PhasePower variables), a non-zero (i.e. positive) total resistance force (signal 6A) may result even if one of the SpeedPower and PhasePower variables is negative at a particular point in time.

The measured speed (or velocity) (RPM) may be measured rapidly and continuously during operation, and the measured speed (or velocity) (RPM) may be rapidly and continuously compared to the target speed to rapidly and continuously adjust the resistance force as a function of speed (or velocity) (FIG. 3). Similarly, the phase and Phase Error may be measured and calculated rapidly and continuously (e.g. tens, hundreds or thousands of times per second), and the resistance due to Phase Error (FIG. 4) can be rapidly and continuously adjusted during operation. Similarly, the integral and/or derivatives of the SpeedPower and PhasePower variables can also be continuously and rapidly updated during operation. Thus, if device 40 comprises a stationary bike, the resistance due to Speed Error (FIG. 3) and/or Phase Error (FIG. 4) may be continuously and rapidly adjusted numerous times over the course of a single crank revolution.

During operation, the system (e.g. processor 50) may be configured to continuously and rapidly adjust the total resistance force (e.g. Brake Power Control Signal 6A; FIG. 1) by combining (numerically adding) the Speed Error Control (FIG. 3) and the Phase Error Control (FIG. 4), and the time integral of the speed and/or phase error. Thus, when the measured speed is within the target range (i.e. between the vertical lines T2 and T3 of FIG. 3), the speed control component is zero or small (approximately zero), and the resistance force signal (Brake Power 6A; FIG. 1) is solely the result of errors in phase as shown in FIG. 4 (if the integral is also zero or if the "I" control is not implemented).

In the illustrated example, the line 98 is a straight line whereby the value of the PhasePower variable increases linearly as the Phase Error increases and decreases. However, the resistance force line 98 may be curved, or have other shapes as required or preferred for a particular application. For example, the line could have a curved shape as shown by the line 98A, which has a zero slope at the intersection with line P1 (i.e. Zero Phase Error), and portions 98B and 98C with increasing slope as the Phase Error increases. Line 98A may be, for example, sinusoidal. Line 98A may provide a less abrupt change in resistance at smaller Phase Angle Errors, and provide significantly increased and decreased resistance force at increased Phase Errors.

In general, the Speed Error Control of FIG. 3 and the Phase Error Control of FIG. 4 may be utilized simultaneously throughout a full range of conditions. However, the system may, optionally, be preferably configured to only implement the phase control of FIG. 4 when the speed control (FIG. 3) satisfies predefined criteria. For example, the predefined criteria may comprise the upper and lower bounds of the speed control corresponding to lines T2 and T3 of FIG. 3. Thus, the system may be configured to only implement the phase-based control of FIG. 4 when the measured speed is between the upper and lower bounds T2 and T3 of FIG. 3. However, it will be understood that the criteria for implementing Phase Error Control (FIG. 4) does not necessarily need to correspond to a range of speed at which the speed-based resistance (FIG. 3) is zero. For example, the Phase Error Control of FIG. 4 could be implemented, if the measured speed (RPM) is between the lines T4 and T5 of FIG. 3, which correspond to speeds (RPMs) that are outside of the constant speed (isokinetic) control range (i.e. lines T2 and T3), such that the resistance could include both speed (RPM) and Phase Error-Based Control components when the measured speed (RPM) error is between the lines T2 and T4, and between the lines T3 and T5 of FIG. 3. Controller 50 may be configured to reset the control signal 6A to upper and lower bounds to provide a limited control signal (variable) if a calculated control signal exceeds predefined upper or lower bounds. Thus, during each loop, the sum of the SpeedPower variable, PhasePower variable, and the integral of these variables may be compared to a lower bound and reset to the lower bound if the sum drops below the lower bound. Similarly, the sum may be reset to an upper bound if the sum exceeds a predefined upper bound. This ensures that the maximum and minimum values limited control signal 6A do not exceed allowable values.

After the value of the control signal is reset (if necessary) to the upper or lower limits, controller 50 utilizes the limited control signal to generate a PWM signal whereby signal 6A comprises a PWM signal. The PWM signal may be scales to provide a brake resistance of 0%-100%. It will be understood that the PWM is merely an example of one form of a control signal, and the brake control signal 6A may have virtually any suitable form.

The measured speed (or velocity) (Measured Crank RPM 4A) (pedal rate) may drift outside the capture range (e.g. out of lines T2 and T3) if a user overdrives the pedals (i.e. pushes the pedals too hard and/or rotates the pedals too fast) or if the user pedals too softly, or too slow, or even stops pedaling briefly. If the speed control criteria and the phase control criteria are mutually exclusive, and if this happens, the Brake Power Control 6 returns to constant speed (isokinetic) control, until the measured speed (or velocity) (Crank RPM) is again within the phase-locked loop capture range.

It will be understood that the Music Synchronization Control of the present disclosure is not limited to a stationary bike, bike trainer, or other specific exercise device. For example, device 40 could comprise a stair climber, a rowing machine, an elliptical machine, a cross trainer, or a variable stride mechanism. Such devices typically include repetitive motion of an input member to which a user applies a force in use. A Target Velocity can be set by a user or other suitable means (e.g. an instructor of a fitness class), and the speed of the movable member can be measured and compared to the target speed and controlled (e.g. FIG. 3), and the phase can also be measured and compared to a target phase, and the resistance force can also be controlled based on errors in phase as shown in FIG. 4. If a movable input member has a speed that varies during each cycle (e.g. an elliptical machine), the target speed at each point in time may correspond to a specific target speed for that portion of the movement based on the position of the input device. Furthermore, the resistance force signal may further include an integral component comprising a time integral of the speed and/or phase errors.

For example, in the case of a rowing machine, the handle and the seat of the rowing machine may move in opposite directions in a periodic manner such that the speed of the handle and the seat may vary between zero and a maximum speed during extension and retraction of the handle and seat. In this case, the target speed may comprise a specific target speed at each point during movement corresponding to and expected or typical speed at each point in time if the overall speed of the handle and seat of the rowing device are moving at an overall target speed. Alternatively, the target speed may comprise a speed at which the time (i.e. the period) of motion of the handle and seat are equal to a period of the Target Velocity whereby the speed-based resistance component (FIG. 3) is zero if the measured period falls within a predefined target range.

In general, the speed and phase control (FIGS. 3 and 4) can be utilized in virtually any type of exercise device by setting or determining target speed and phase, and providing variable resistance force based on errors in speed and phase.

It is to be understood that variations and modification can be made on the aforementioned structure without departing from the concepts of the present invention, and further it is to be understood that such concepts are intended to be covered by the following claims unless these claims by their language expressly state otherwise.

The invention claimed is:

1. An exercise system comprising:

a movable input member that is configured to move while a force is applied to the movable input member by a user;

a brake configured to generate a resistance force that tends to resist movement of the movable input member when the user applies force to the movable input member; and a controller operably connected to the brake, wherein the controller is configured to control the resistance force to synchronize movement of the movable input member with a music beat utilizing speed-based control and phase-based control, wherein the controller is configured to implement the speed-based control and the phase-based control according to predefined criteria and wherein a target speed and a target phase are determined utilizing the music beat.

2. The exercise system of claim 1, wherein:

the movable input member comprises a crank of a stationary exercise bike having first and second pedals; and including:

one or more sensors configured to measure position and speed of the crank; and wherein:

the controller is configured to determine a speed error by taking a difference between a measured speed and the target speed; and the controller is configured to determine a phase error by taking a difference between a measured phase and the target phase.

3. The exercise system of claim 2, wherein:

the speed-based control comprises a constant speed control whereby the resistance force tends to cause the speed of the movable member to fall within a predefined range of the target speeds.

4. The exercise system of claim 3, wherein:

the target phase comprises target pedal positions and corresponding target times; and the phase error comprises a difference in position between the target pedal position and the measured pedal position at the target time corresponding to the target pedal position.

5. The exercise system of claim 4, wherein:

the controller is configured to rapidly determine the speed error and the phase error during operation of the stationary bike and to adjust the resistance force a plurality of times during each revolution of the crank based on at least one of the speed error and the phase error.

6. The exercise system of claim 1, wherein:

the predefined criteria comprises upper and lower bounds of a range of target speed.

7. The exercise system of claim 1, wherein:

the controller is configured to determine a speed error comprising a difference between the target speed and a measured speed, and to utilize the speed error as an input for the speed-based control.

8. An exercise system of claim 1, wherein comprising:

a movable input member that is configured to move while a force is applied to the movable input member by a user;

a brake configured to generate a resistance force that tends to resist movement of the movable input member when the user applies force to the movable input member;

a controller operably connected to the brake, wherein the controller is configured to control the resistance force to synchronize movement of the movable input member with a music beat utilizing speed-based control and phase-based control, wherein the controller is configured to implement the speed-based control and the phase-based control according to predefined criteria, and wherein the controller is configured to determine a phase error comprising a difference between a target phase and a measured phase, and to utilize the phase error as an input for the phase-based control.

9. The exercise system of claim 8, wherein:

the controller is configured to control the resistance force based on a sum of the speed error and the phase error.

10. The exercise system of claim 9, wherein:

the controller is configured to control the resistance force based on the sum of the speed error and the phase error and an integral of the sum of the speed error and the phase error.

11. The exercise system of claim 10, wherein:

the controller is configured to vary a phase-based component of the resistance force linearly as a function of the difference between the target phase and the measured phase.

12. The exercise system of claim 8, wherein:

the target phase comprises target pedal positions and corresponding target times.

13. An exercise system comprising:

a movable input member that is configured to move while a force is applied to the movable input member by a user;

a brake configured to generate a resistance force that tends to resist movement of the movable input member when the user applies force to the movable input member;

a controller operably connected to the brake, wherein the controller is configured to control the resistance force to synchronize movement of the movable input member with a music beat utilizing speed-based control and phase-based control, wherein the controller is configured to implement the speed-based control and the phase-based control according to predefined criteria;

the controller is configured to determine a speed error comprising a difference between a target speed and a measured speed, and to utilize the speed error as an input for the speed-based control;

the controller is configured to determine a phase error comprising a difference between a target phase and the measured phase, and to utilize the phase error as an input for the phase-based control; and the predefined criteria permits at least some overlap of the speed-based control and the phase-based control such that during at least some operating conditions the controller simultaneously controls the resistance force based on both the speed error and the phase error.

14. The exercise system of claim 13, wherein:

the target phase comprises target pedal positions and corresponding target times.

15. An exercise system comprising:

a movable input member that is configured to move while a force is applied to the movable input member by a user;

a brake configured to generate a resistance force that tends to resist movement of the movable input member when the user applies force to the movable input member;

a controller operably connected to the brake, wherein the controller is configured to control the resistance force to synchronize movement of the movable input member with a music beat utilizing speed-based control and phase-based control, and wherein the controller is configured to implement the speed-based control and the phase-based control according to predefined criteria;

the controller is configured to determine a speed error comprising a difference between a target speed and a measured speed, and to utilize the speed error as an input for the speed-based control;

the controller is configured to determine a phase error comprising a difference between a target phase and a measured phase, and to utilize the phase error as an input for the phase-based control; and the predefined criteria is mutually exclusive such that the controller is configured to implement only the speed-based control or the phase-based control at each point in time during operation of the exercise system.

16. The exercise system of claim 15, wherein:

the target phase comprises target pedal positions and corresponding target times.

17. An exercise system comprising:

a movable input member that is configured to move while a force is applied to the movable input member by a user;

a brake configured to generate a resistance force that tends to resist movement of the movable input member when the user applies force to the movable input member; and a controller operably connected to the brake, wherein the controller is configured to control the resistance force to synchronize movement of the movable input member with a music beat utilizing speed error and phase error, wherein the speed error comprises a difference between a target speed and a measured speed, and the phase error comprises a difference between a target phase and a measured phase;

wherein the controller increases the resistance force relative to a baseline resistance force when: 1) the speed error is caused by the measured speed exceeding the target speed; and: 2) the phase error is caused by the movable input member being ahead of the target phase;

and wherein the target speed and the target phase are determined, based at least in part, on the music beat.

18. The exercise system of claim 17, wherein:

the controller is configured to utilize a sum of the speed error and the phase error control the resistance force.

19. The exercise system of claim 18, wherein:

the controller is configured to utilize an integral of the sum of the speed error and the phase error to control the resistance force.

20. The exercise system of claim 17, wherein:

the controller is configured to utilize the phase error to control the resistance force according to predefined phase control criteria.

21. The exercise system of claim 17, wherein:

the target phase comprises target pedal positions and corresponding target times.

22. A method of controlling an exercise device to synchronize movement of an input member of the exercise device to music, the method comprising:

utilizing a music beat to determine a target phase and a target speed; and utilizing a phase-based control and a speed-based control to control a resistance force applied to a movable input member of the exercise device while a force is applied to the movable input member by a user, wherein the resistance force is controlled in a manner tending to cause movement of the movable input member to be synchronized to the music beat;

wherein the phase-based control comprises varying the resistance force in a manner that ends to minimize a difference between a measured phase and the target phase;

and wherein the speed-based control comprises varying the resistance force in a manner that tends to minimize a difference between a measured speed and a target speed.

23. The method of claim 22, wherein:

the target phase comprises target pedal positions and corresponding target times.

24. A method of controlling an exercise device to synchronize movement of an input member of the exercise device to music, the method comprising:

utilizing a music beat to determine at least one of a target phase and a target speed;

utilizing a phase-based control and a speed-based control to control a resistance force applied to a movable input member of the exercise device while a force is applied to the movable input member by a user, wherein the resistance force is controlled in a manner tending to cause movement of the movable input member to be synchronized to the music beat; wherein the phase-based control comprises varying the resistance force in a manner that tends to minimize a difference between a measured phase and the target phase; and wherein the speed-based control comprises varying the resistance force in a manner that tends to minimize a difference between a measured speed and a target speed;

while the movable input member is moving, repeatedly determining if predefined phase control criteria are satisfied;

switching from the speed-based control to the phase-based control when the predefined phase control criteria changes from not being satisfied to being satisfied; and switching from the phase-based control to the speed-based control when the predefined phase control criteria changes from being satisfied to not being satisfied, wherein the predefined phase control criteria comprises the measured need being within a range of the target speed.

25. The method of claim 24, wherein:

the target phase comprises target pedal positions and corresponding target times.

* * * * *